United States Patent [19]

McOwen, Jr.

[11] 4,208,660

[45] Jun. 17, 1980

[54] RADIO FREQUENCY RING-SHAPED SLOT ANTENNA

[75] Inventor: Sherwood A. McOwen, Jr., Santa Barbara, Calif.

[73] Assignee: Raytheon Company, Lexington, Mass.

[21] Appl. No.: 850,743

[22] Filed: Nov. 11, 1977

[51] Int. Cl.[2] ..... H01Q 13/10; H01Q 13/18

[52] U.S. Cl. ..... 343/769; 343/789

[58] Field of Search ..... 343/700 MS, 768, 769, 343/854, 789

[56] References Cited

U.S. PATENT DOCUMENTS

| | | | |
|---|---|---|---|
| 3,791,769 | 5/1957 | Lindenblad | 343/769 |
| 3,971,125 | 7/1976 | Thies | 343/769 |

*Primary Examiner*—Eli Lieberman

*Attorney, Agent, or Firm*—Richard M. Sharkansky; Joseph D. Pannone

[57] ABSTRACT

An array antenna is disclosed wherein each one of the antenna elements includes at least two concentric slots formed in a conductive sheet. The conductive sheet is disposed on a dielectric support and a ground plane is found on the opposite surface of such support. The inner one of the slots enables the outer slot to radiate radio frequency energy having a wavelength greater than the circumference of such outer slot. When such antenna includes an additional concentric slot the antenna is adapted to operate over a pair of frequencies separated by greater than twenty percent while enabling the array antenna to have satisfactory grating lobe characteristics.

2 Claims, 8 Drawing Figures

RADIO FREQUENCY RING-SHAPED SLOT ANTENNA

The invention herein described was made in the course of or under a contract or subcontract thereunder, with the Department of Defense.

BACKGROUND OF THE INVENTION

This invention relates generally to radio frequency antennas and more particularly to array antennas which include annular slot-type stripline antenna elements.

As is known in the art, annular slot-type stripline antenna elements are useful in radio frequency antennas, as where such an antenna is to be substantially flush-mounted to a vehicle, such as an aircraft or a missile. One such annular slot-type stripline antenna element is described in U.S. Pat. No. 3,665,480, Annular Slot Antenna With Stripline Feed, Inventor Matthew Fassett, issued May 23, 1972 and assigned to the same assignee as the present invention. As discussed therein, the antenna element includes a pair of parallel conductive plates formed on opposiite faces of a dielectric support structure, one of which has formed therein a generally annular radiating slot of substantially uniform width, and a feed element disposed between the parallel plates and extending radially into the central region of the annular slot for feeding electromagnetic energy into such slot. The electromagnetic energy has an electrid field component, the magnitude of which varies cosinusoidally with position from the feed about the circumference of the slot. A condition of resonance occurs when the circumference of the slot is approximately one wavelength. The phase of the electric field induced in the slot will then vary uniformly from 0° to 360° around the circumference of the slot which thereby produces a radiated field having its maximum intensity along the axis which is normal to the surface of the slot. In practice, for a slot with a finite width it has been found that the inner circumference of the slot should be approximately ten percent greater than the operating wavelength.

As described in the above-referenced U.S. patent, the antenna therein disclosed has a bandwidth in the order of 10%. Therefore, while such antenna has been found adequate in many applications, it is, however, frequently desirable to provide an antenna which is adapted to operate at frequencies which are separated by greater than 10%, say where one frequency is one-third greater than a second frequency.

As is further known in the art, in an array antenna the spacing, "a", between the centers of adjacent antenna elements must be a $\leqq (1-1/N)\,\lambda_H/(1+\sin\theta)=K\lambda_H$, (where N is the number of antenna elements along a scan axis of the array antenna, $\lambda_H$ is the wavelength of the highest operating frequency of the array antenna, $\theta$ is the maximum angular deviation of the beam from the boresight axis of the array antenna, and K is a proportionality constant, $(1-1/N)/(1+\sin\theta)$ in order to obtain satisfactory grating lobe reduction. Therefore, if a first annular slot antenna element of the type discussed above were provided to accommodate the higher frequency and if it is desired to have the array operate at a second, lower frequency by means of a second, separately fed, concentric annular slot of the above type, it follows that the circumference of such second slot would be $=1.1\lambda_L$ (where $\lambda_L$ is the wavelength of such lower frequency) and the diameter, S, of such second slot would be $1.1\lambda_L/\pi$. Therefore, in order to satisfy the requirement for grating lobes "a" $\leqq K\lambda_H$ and the physical space requirement (i.e. no overlapping) for the second slot, the diameter of the second slot, S, must be less than (or equal to) "a", i.e. S $\leqq$ "a" or $1.1\lambda_L/\pi \leqq K\lambda_H$. Therefore, for example, for an array antenna where $\theta$ is 80° and N=6, K=0.42, and $$\lambda_L/\lambda_H \frac{\leqq \pi K}{1.1} = 1.2.$$

However, because of the physical space required for the feed elements and because the circumference of the radiating slot is about 10% greater than $\lambda_L$ as discussed above, and considering that the slots have finite widths, the maximum ratio of $\lambda_L/\lambda_H$ in a practical case is less than 1.2. Consequently, considering also that space must be allowed for both feeds, the above described approach will not provide an array antenna of such type where such antenna is to operate at frequencies separated by over twenty percent.

SUMMARY OF THE INVENTION

With this background of the invention in mind it is therefore an object of this invention to provide an improved flush mountable array antenna adapted to operate over a pair of frequencies separated by greater than twenty percent and have a radiation pattern with the maximum gain along the boresight axis of the antenna.

This and other objects of the invention are attained generally by providing, in an array antenna, a plurality of antenna elements, each one of such elements comprising: a pair of substantially parallel electrically conducting plates in spaced apart relationship, at least two concentric apertures of substantially uniform width provided in one of the conductive plates, one of such pair of apertures radiating radio frequency energy having a wavelength greater than the circumference of such radiating one of the pair of apertures, and a feed element supported by a dielectric support structure in spaced parallel relationship between the conductive plates.

The second one of the pair of apertures enables the radiating aperture to radiate energy having a wavelength greater than the circumference of the radiating aperture thereby enabling the array antenna to operate at a pair of frequencies having a separation of greater than twenty percent while enabling satisfactory grating lobe characteristics. It is believed that the second aperture provides additional phase retardation to the electric field vector as it travels about the circumference of the aperture, thereby enabling the radiating aperture to radiate energy having a wavelength greater than the circumference of the radiating aperture.

BRIEF DESCRIPTION OF THE DRAWINGS

The foregoing features of this invention, as well as the invention itself, may be more fully understood from the following detailed description read together with the accompanying drawings, in which.

DESCRIPTION OF THE PREFERRED EMBODIMENT

Array Antenna

Figure 1:
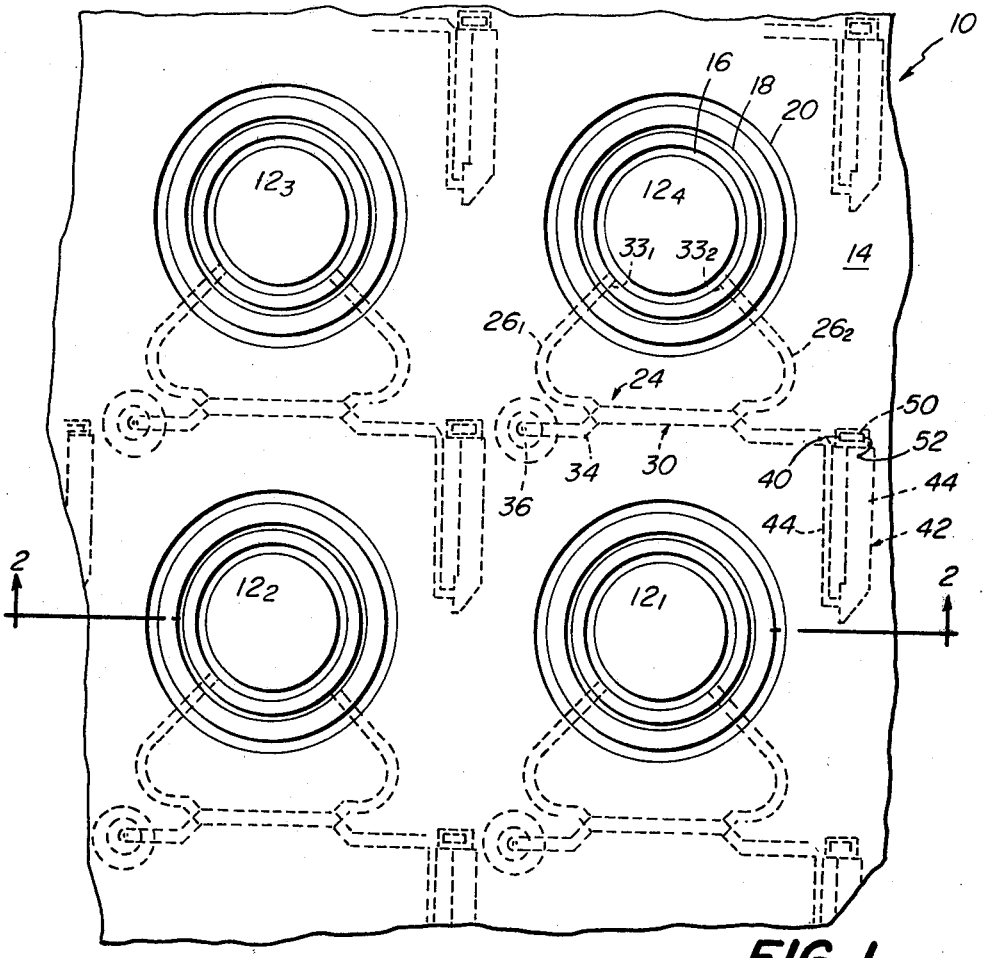
FIG. 1 is a plan view of a portion of an array antenna according to the invention.
Figure 2:
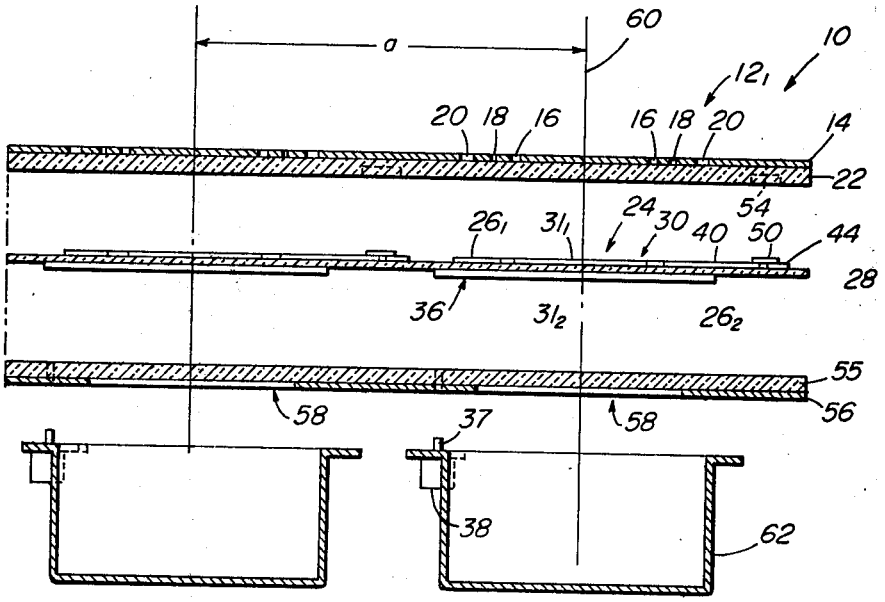
FIG. 2 is an exploded cross-sectional view of the array antenna taken along the line 2—2 shown in FIG. 1.
Figure 3:
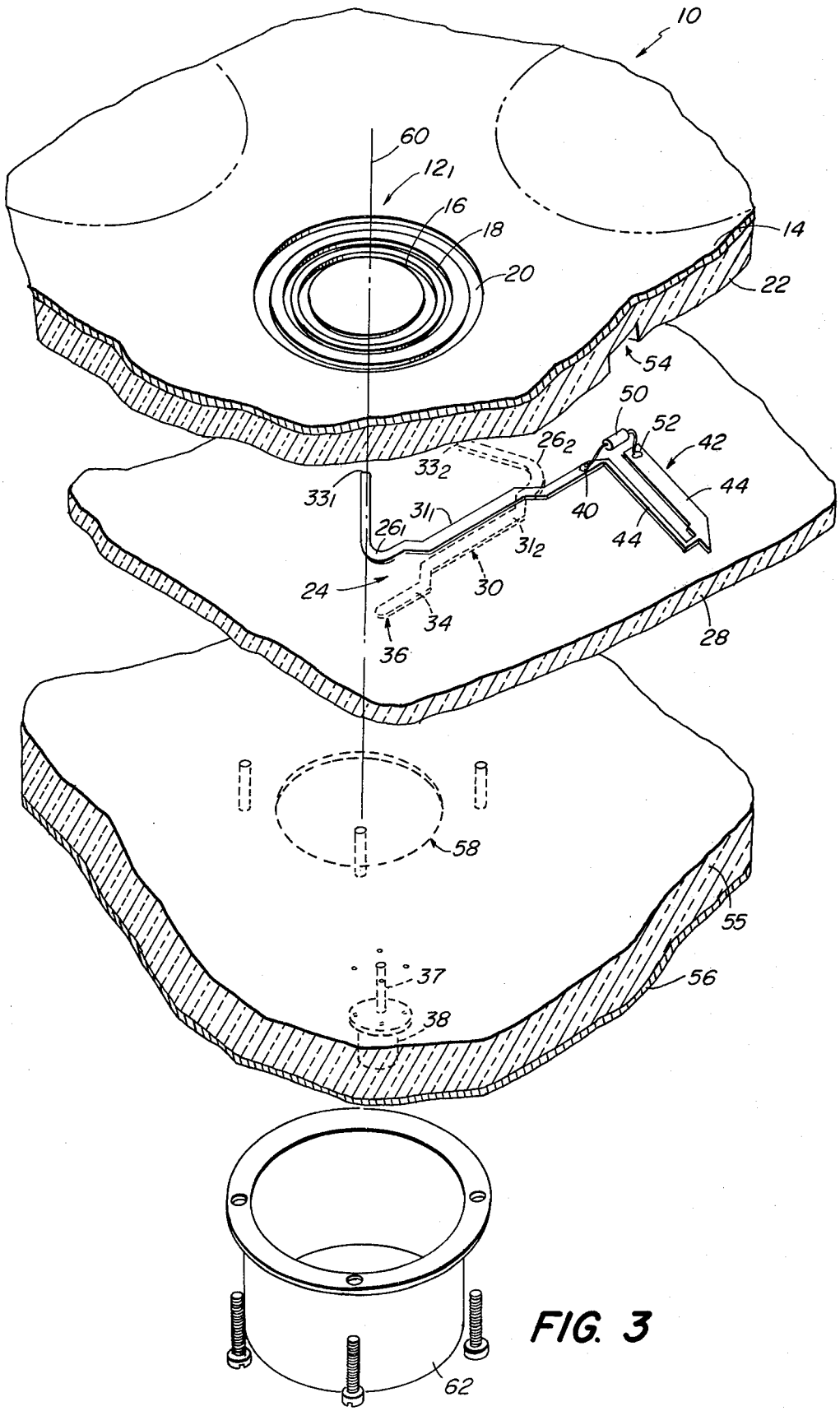
FIG. 3 is an exploded isometric view of a portion of the array antenna shown in FIG. 1.

Referring now to FIGS. 1, 2 and 3, an array antenna 10 is shown to include a plurality of, here thirty-six, antenna elements (only antenna elements $12_1$-$12_4$ being shown in FIG. 1) arranged in a rectangular 6×6 matrix. Such array antenna 10 is adapted to operate at a pair of frequencies $f_1$,$f_2$, here in the order of 1.5 GHz and 1.2 GHz, respectively, and produce a radiation pattern which has its maximum gain along an axis normal to the face of the array (i.e. the boresight axis). The maximum scan angle, i.e. the deviation of the beam from the boresight axis, is here 80°. Each one of the antenna elements is identical in construction. An exemplary one thereof, here antenna element $12_1$, is shown in detail to include an electrically conductive sheet 14, here copper, having formed therein, using conventional photolithographic processes, three concentric circular apertures, or slots, 16, 18, 20. The inner diameter of the inner slot 16 is here 1.36 inches and the outer diameter of such inner slot 16 is here 1.56 inches. The inner diameter of the middle slot 18 is here 1.84 inches and the outer diameter of such middle slot 18 is here 1.95 inches. The inner diameter of the outer slot 20 is here 2.32 inches and the outer diameter of such outer slot 20 is here 2.66 inches. The center-to-center spacing between adjacent antenna elements, i.e. the exemplary length a (FIG. 2), is here 3.2 inches. The conductive sheet 14 is formed on a dielectric substrate 22, here a sheet of Teflon-Fiberglass material having a dielectric constant of 2.55 and a thickness of 1/16 inch.

Each one of the antenna elements includes a single feed structure 24 for enabling such element to radiate circularly polarized waves. In particular, such feed is made of copper and includes a pair of feed lines $26_1$, $26_2$, each of which extends along a radius of the slots 16, 18, 20. Such feed lines $26_1$, $26_2$ are disposed in 90° spatial relationship as indicated to enable the antenna to operate with circular polarization. One of such pair of feed lines, here feed line $26_1$, is formed on the top side of a Mylar sheet 28 (here such sheet 28 having a thickness of 0.006 inches) and the other one of such feed lines, here feed line $26_2$, is formed on the bottom side of such sheet 28. The feed structure 24 is formed using conventional photolithographic processes. The feed lines $26_1$, $26_2$ are coupled to a conventional 90° hybrid coupler 30. The portions $31_1$, $31_2$ of feed lines $26_1$, $26_2$ overlap one another in the central region of the hybrid coupler 30 as shown (FIGS. 2, 3). The ends $33_1$, $33_2$ of the feed lines $26_1$, $26_2$ are spaced from the center of the antenna element $12_1$ a length, here 0.775 inches. The 90° hybrid coupler 30 has one port 34 connected to the center conductor 37 of a conventional coaxial connector 38 (here by solder) and a second port 40 connected to a terminating structure 42, the details of which will be described hereinafter. Suffice it to say here that such terminating structure provides an impedance matching structure for the hybrid coupler 30 and includes a strip conductor 44 (here copper) formed on the sheet 28 by conventional photolithography at the same time the feed line $26_1$ is being formed on such sheet 28 and a resistive load 50, here a carbon resistor, coupled between port 40 and a second end 52 of the strip conductor 44. The resistive load 50 is here adapted to dissipate substantially all of the radio frequency energy fed to the terminating structure 42.

A recess 54 is formed, here using conventional machining, in the dielectric substrate 22, for the resistive load 50, thereby enabling the dielectric substrate 22 and the sheet 28 to form a smooth, planar, compact structure when assembled one to the other in any conventional manner, here by affixing the sheet and substrate with a suitable nonconductive epoxy (not shown) about the peripheral portions of the entire array.

A second dielectric substrate 55, here also Teflon-Fiberglass material, having a dielectric constant of 2.55 and a thickness of 1/16 inch is provided and is suitably affixed to the sheet 28 to form a sandwich structure when assembled. The dielectric sheet 55 has an electrical conductive sheet 56, here copper, formed on the bottom side thereof, as shown. Such conductive sheet 56 has circular apertures 58 formed therein using conventional photolithography. Each one of the apertures 58 is associated with a corresponding one of the antenna elements, as shown. The apertures 58 have a diameter of here 2.195 inches and the centers of such apertures are along axes which pass through the centers of the antenna elements associated therewith. For example, for exemplary antenna element $12_1$ the axis is represented by dotted line 60 in FIGS. 2 and 3.

Also associated with each one of the antenna elements is a cavity formed by a circular, cup-shaped element 62, here formed from aluminum. Such element 62 has a mounting flange for electrically and mechanically connecting such element to conductive sheet 56, such element 62 being disposed symmetrically about the circular aperture 58, as shown. Each cup-shaped element has a diameter of here 2.85 inches, a height of here 1.0 inches and a center which is aligned with the axis represented by dotted line 60 (i.e. the center of the associated antenna element). The conductive sheet 56 and the cup-shaped element 62 associated therewith form, inter alia, a ground plane for the associated antenna element. The outer conductor of the coaxial connector 38 used to feed such element is electrically and mechanically connected to the ground plane, in particular to the conductive sheet 56.

When assembled, the array antenna 10 provides a compact flush-mountable array antenna adapted to operate at 1.2 and 1.5 GHz. It is noted that the spacing between antenna elements "a" is less than $(1-1/N)\lambda_H/(1+\sin\theta)$ where N is the number of antenna elements along a scan axis of the array antenna (here N=6), $\theta$ is the maximum angular deviation of the beam from the foresight axis of the array (here $\theta=80°$) and $\lambda_H$ is the wavelength of the highest operating frequency of the antenna, here 1.5 GHz ($\lambda_H=7.86$ inches), that is "a"=3.2 inches and is less than 3.3 inches, thereby enabling the array antenna 10 to have satisfactory grating lobe characteristics. Further, it has been determined that the middle slot 18 enables the outer slot 20 to radiate radio frequency energy having a frequency 1.2 GHz, such energy having a wavelength $\lambda_L=9.8$ inches, which is greater than the circumference of such outer slot 20. That is, the largest slot, outer slot 20, radiates energy having a wavelength greater than the circumference of such outer slot 20. Likewise, the inner slot 16 enables the middle slot 18 to radiate radio frequency energy having a frequency 1.5 GHz, such energy having a wavelength $\lambda_H=7.86$ inches which is greater than the circumference of such middle slot 18. That is, the middle slot 18 radiates energy having a wavelength greater than the circumference of such middle slot 18.

Figure 4:
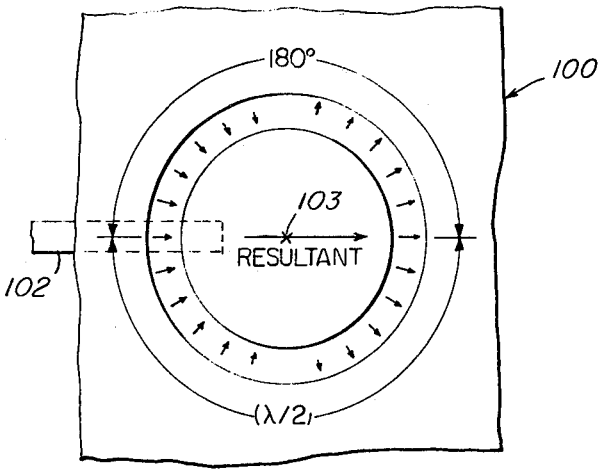
FIG. 4 is a drawing showing the electric field vector distribution developed within a single slotted antenna element excited by a single feed element.

One way to possibly understand the effect of the middle slot 18 on the operation of the outer slot 20 or, likewise, the effect of the inner slot 16 on the operation of the middle slot 18 is as follows: Referring to FIG. 4, a conventional slot antenna element 100 of the type described in U.S. Pat. No. 3,665,480, it is noted that the electric field distribution varies as shown by the arrows when such slot is fed by the feed line as indicated. It is apparent that, if the circumference of the slot is the operating wavelength the electric field component varies cosinusoidally with position around the slot. Therefore, considering, for example, a point 180° from the feedline 102, it is noted that because such point is electrically $\lambda/2$ in length from the feed line the phase of such field rotates 180° while the vector is also spatially rotated 180°. Therefore, the electric field vectors at the feedline 102 and at the point 180° from such feed line are aligned, as shown. Likewise, considering all electric field components it follows that a resultant field vector is produced, when the circumference of the slot is $\lambda$, which is normal to the boresight axis of the antenna, thereby producing a beam of radiation having its maximum gain along such boresight axis 103.

Figure 5:
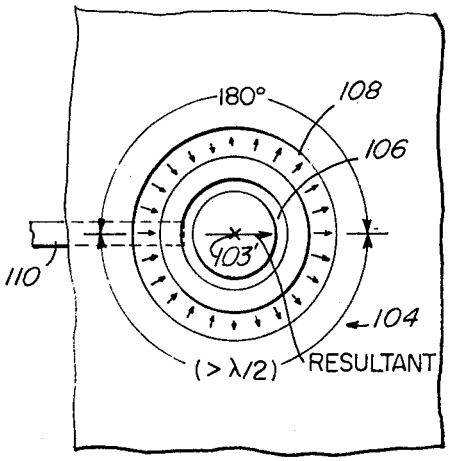
FIG. 5 is a drawing showing the electric field vector distribution developed within a dual annular slotted antenna element excited by a single element.

Referring now to FIG. 5, a two slot element 104 is shown. Because of the inner slot 106 the outer slot 108 radiates radio frequency energy having a wavelength greater than the circumference of the outer slot 108, i.e., in the order of 30% greater. As presently understood, it is felt that the inner slot 106 provides additional electrical phase retardation to the electric field vector as it propagates from the feed line 110 about the slot so that, for example, at a point 180° from such feed line 110 the phase of such field has rotated electrically 180°. Therefore, as indicated in FIG. 5, the resultant electric field vector is normal to the boresight axis 103' and the array antenna produces a beam of radiation having its maximum gain along the boresight axis of the array (i.e., normal to the face of the array).

Terminating Structure

Figure 6:
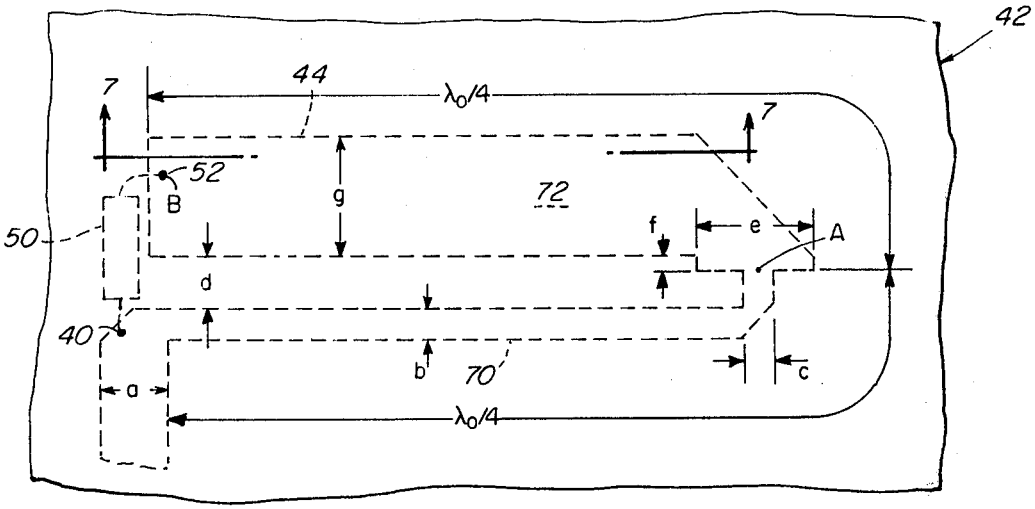
FIG. 6 is a plan view of a terminating structure used with the antenna of FIG. 1.
Figure 7:
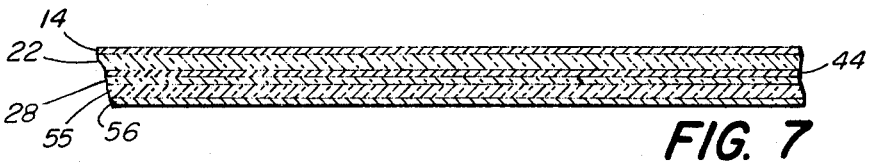
FIG. 7 is a cross-sectional view of a portion of the terminating structure shown in FIG. 6, such cross section being taken along the line 7—7 shown in FIG. 6.

Referring now to FIGS. 6 and 7, the terminating structure 42 is shown. Such terminating structure 42 is here a stripline terminating structure adapted to provide a loading circuit for the stripline feed network 24 (FIGS. 1, 2 and 3). As discussed briefly above, such structure 42 includes a strip conductor 44 formed on one surface, here the upper surface, of Mylar sheet 28, such sheet 28 being sandwiched between a pair of dielectric substrates 22, 55 as shown. The conductive sheets 14, 56 formed on such substrates 22, 55, respectively, provide ground planes for the feed line $26_1$ of feed network 24 and the strip conductor 44. The strip conductor 44 is integrally formed with the upper portion of hybrid junction 30, as discussed above, and, therefore, one end of feed line $26_1$ and one end of strip conductor 44 are connected to form a first junction 40. A resistive load 50, here a conventional carbon resistor, is deposited on the upper surface of Mylar sheet 28 as shown in FIGS. 2 and 3. Such resistive load 50 has one electrode electrically connected to the first junction 40 and a second electrode electrically connected to a second end 52 of the strip conductor 44. Such connections are here made by soldering the electrodes of resistive load 50 to the copper strip conductors forming junction 40 and the second end 52 of strip conductor 44. As will be discussed, the resistive load 50 is provided to absorb, or dissipate, substantially all of the radio frequency energy which passes to the terminating structure 42 from the feed network 24. That is, as will be discussed, the terminating structure 42 is designed so that the Voltage Standing Wave Ratio (VSWR) at the input to such structure 42, i.e., at junction 40, is 1.0 for energy having a wavelength $\lambda_o=(\lambda_H+\lambda_L)/2$. It is noted that $\lambda_o$ is the normal operating wavelength of the array antenna 10 (FIG. 1). Here the strip conductor 44 extends from the junction 40 to end 52 and has an electrical length $\lambda_o/2$.

Figure 8:
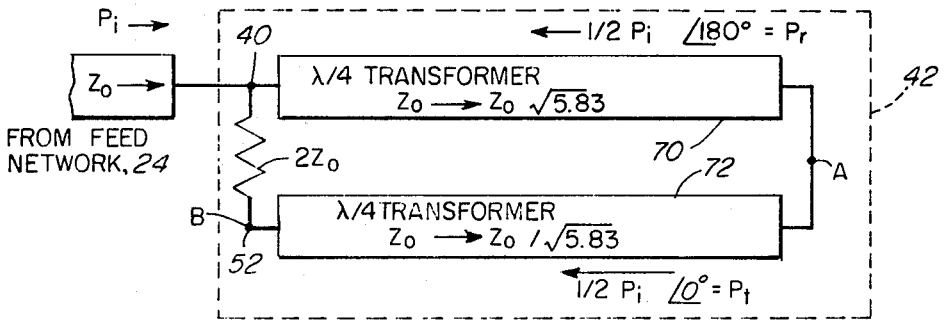
FIG. 8 is a schematic diagram of the terminating structure shown in FIGS. 6 and 7.

The terminating structure 42 includes two quarter-wave ($\lambda/4$) transmission line sections 70, 72. Transmission line section 70 extends from junction 40 to a point A (FIG. 6), and transmission line section 72 extends from point A to end 52. The first $\lambda/4$ transmission line section 70 serves as an impedance transformer to transform the impedance of the strip feed network 24 feeding the terminating structure 42 (i.e., a microstrip transmission line formed by the feed line $26_1$ and its pair of ground planes), here $Z_0=50$ ohms, to an impedance at point A which causes an impedance mismatch at point A of 5.83:1. That is, referring also to FIG. 8, the first $\lambda/4$ transmission line section 70 transforms the impedance $Z_0$ at the input to such section 70 to an impedance $Z_0\times\sqrt{5.83}$ at point A. Therefore, because the first transmission line section 70 is a $\lambda/4$ impedance transformer, in order to match the input impedance of the line to the terminating impedance of such line, the impedance of such line must equal $\sqrt{(Z_0)(Z_0\sqrt{5.83})}$. Next, because at point A $$\frac{P_R}{P_i}=\left\{\frac{VSWR-1}{VSWR+1}\right\}^2$$

where $P_R$ is the reflected power at point A and $P_i$ is the incident power at point A, for $P_R=\frac{1}{2}P_i$ at point A, $$VSWR=5.83.$$

Since the transmitted power $P_t$ is equal to the incident power $P_i$ minus the reflected power $P_r$, $P_t=\frac{1}{2}P_i=P_r$.

Therefore, in order to obtain such a VSWR of 5.83 at point A and also in order for the impedance of the second transmission line section 72 to be $Z_0$ at point B, the second transmission line section 72 is designed to transform the impedance $Z_0$ at point B to an impedance $Z_0/\sqrt{5.83}$ at point A. It follows then that, for impedance matching, the impedance of the second transmission line section 72 becomes $\sqrt{(Z_0)(Z_0)/\sqrt{5.83}}=Z_0/\sqrt[4]{5.83}$. At the nominal operating wavelength, $\lambda_o$, $Z_1$ (which is the impedance of line 70 at point (A) is equal to $Z_0\sqrt{5.83}$ and $Z_2$ (which is the impedance of line 72 at point (A) is equal to $Z_0/\sqrt{5.83}$. Both impedances are "real" because of the quarter-wave transformers. It follows that the sign of the reflection coefficient is negative since $$\rho = \frac{Z_2 - Z_1}{Z_2 + Z_1} = -.707.$$

It is also noted that since $Z_1$ and $Z_2$ are positive and real the sign of the transmission coefficient, T, $$(T = \frac{2Z_2}{Z_1 + Z_2})$$

is positive. This difference in sign between $\rho$ and T indicates a 180° phase difference between the reflected and incident voltages ($V_r$, $V_i$) at point A since $V_r = \rho V_i$ and $V_t = TV_i$. This phase relationship is preserved at points 40, 52 since the reflected and transmitted waves travel in identical media. Also, the impedance of points 40 and 52 are equal as discussed. Consequently, equal and opposite voltages are produced at points 40 and 52.

It is noted that the terminating structure 42 may be considered as a balun (balancing unit) which is terminated in a resistive load. That is, the terminating structure 42 may be considered as a microwave circuit which changes the stripline feed network 24 from an unbalanced line to a balanced line between junction 40 and end 52. This is accomplished by establishing VSWR of 5.83 at point A so that one-half of the incident power is reflected back along one of two parallel paths while transmitting the remaining one-half of the power along the second path so that the voltages at junction 40 and end 52 are equal in magnitude and opposite in phase (i.e., 180° out-of-phase) because the reflection at point A is brought about by a resistive mismatch which produces a 180° phase difference between $V_i$ and $V_t$ as discussed.

Therefore, the load 50 carries a current developed because of the voltage difference produced between port 40 and end 52 and, hence, such load dissipates the power associated with such current. The resistive load 50 here has an impedance $2Z_0 = 100$ ohms.

The dimensions of the strip circuitry shown in FIG. *6* are here:

a 0.085 inches
b 0.034 inches
c 0.034 inches
d 0.06 inches
e 0.160 inches
f 0.02 inches
g 0.160 inches Having described a preferred embodiment of this invention, it is evident that other embodiments incorporating its concepts may be used. It is felt, therefore, that this invention should not be restricted to such preferred embodiment but rather should be limited only by the spirit and scope of the appended claims.

What is claimed is:

1. An array antenna comprising: a plurality of, N, antenna elements, adapted to produce a beam having a maximum angular deviation $\theta$ from the boresight axes of the array, adjacent ones of such elements being separated a length less than $a = (1 - 1/N)\lambda_H/(1 + \sin\theta)$ where $\lambda_H$ is the wavelength of the highest operating frequency of the antenna, each one of such elements comprising: a pair of substantially parallel electrically conducting plates in spaced-apart relationship at least two concentric apertures of substantially uniform width provided in one of the conductive plates, an outer one of such pair of apertures radiating radio frequency energy having the wavelength $\lambda_H$ which is greater than the circumference of such outer radiating one of the pair of apertures.

2. The antenna recited in claim 1 including a feed element for each antenna element supported by a dielectric support structure in spaced-apart relationship between the conductive plates.

* * * * *